United States Patent [19]

Mathis

[11] 4,351,694

[45] Sep. 28, 1982

[54] RACK FOR LAYING ITALIAN AND QUARRY TILE

[76] Inventor: Ronald R. Mathis, 3011 E. Wethersfield, Phoenix, Ariz. 85032

[21] Appl. No.: 311,520

[22] Filed: Oct. 15, 1981

[51] Int. Cl.[3] ..... B44C 7/00

[52] U.S. Cl. ..... 156/574; 156/71; 156/297; 156/561

[58] Field of Search ..... 156/71, 560–562, 156/297, 538, 574; 52/384–392, 477, 604, 744

[56] References Cited

U.S. PATENT DOCUMENTS 3,005,293 10/1961 Hunter ..... 52/604 X 3,745,735 7/1973 Casano ..... 52/390

3,866,300 2/1975 Bell ..... 156/574 X 4,135,338 1/1979 Malavasi ..... 52/389 X

*Primary Examiner*—David A. Simmons

*Attorney, Agent, or Firm*—Warren F. B. Lindsley

[57] ABSTRACT

An improved rack for laying tiles with provision for preventing contact of the main rack surfaces with the tile adhesive and with means for adjustment of rack dimensions to permit accommodation of different tile sizes. A lightweight and inexpensive rack is provided in a form that facilitates assembly so that the rack may be readily shipped or stored in unassembled form.

7 Claims, 18 Drawing Figures

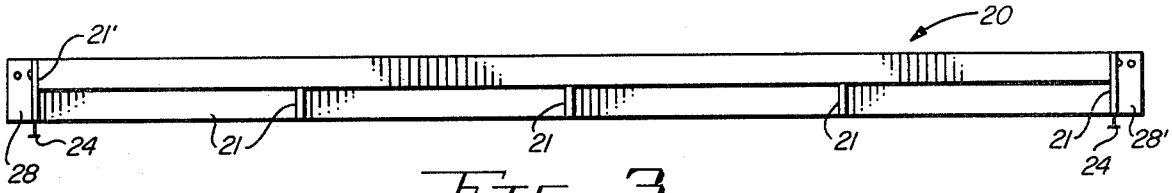
FIG. 3
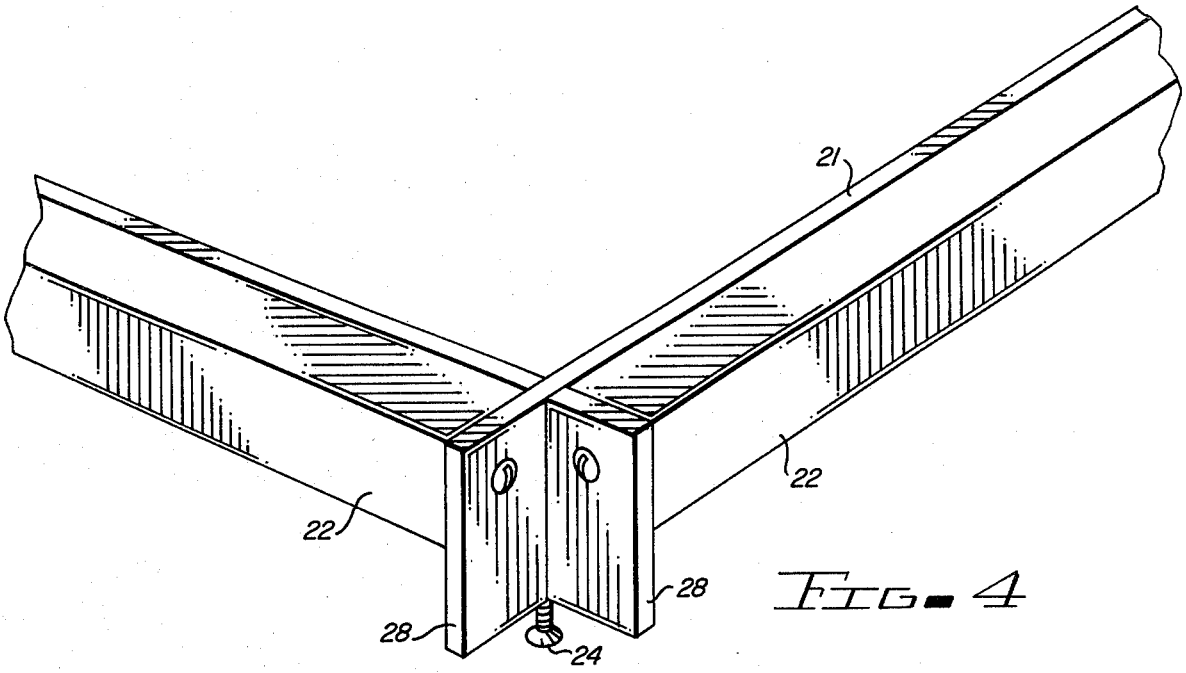
FIG. 4
FIG. 5
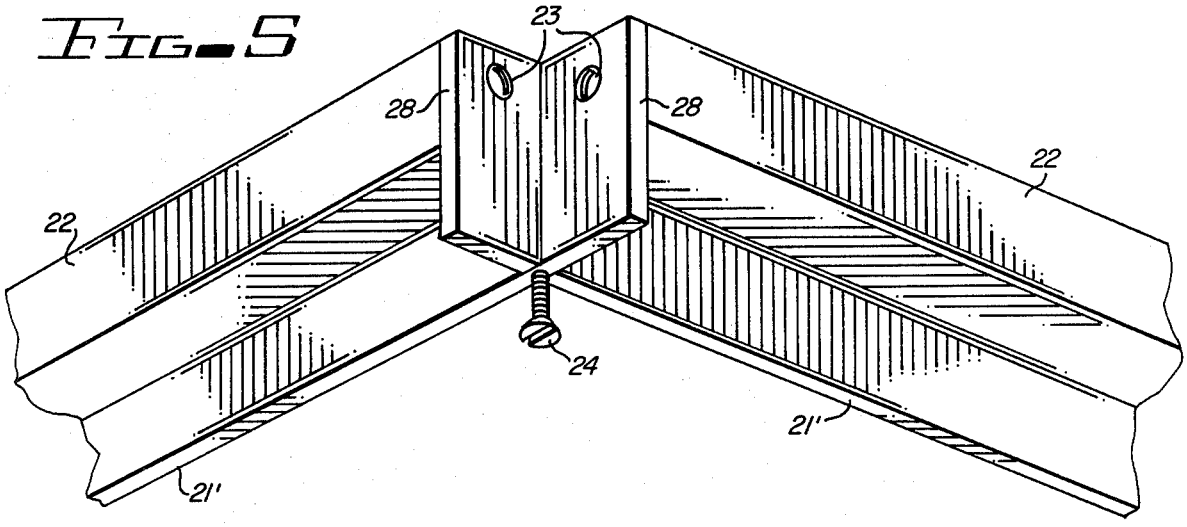
FIG. 7A
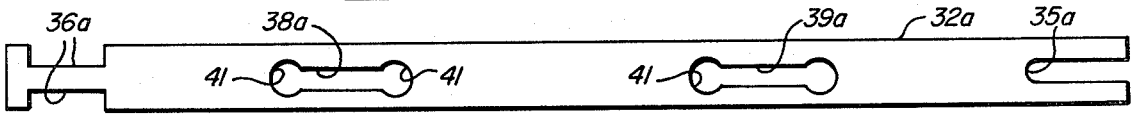

FIG. 6
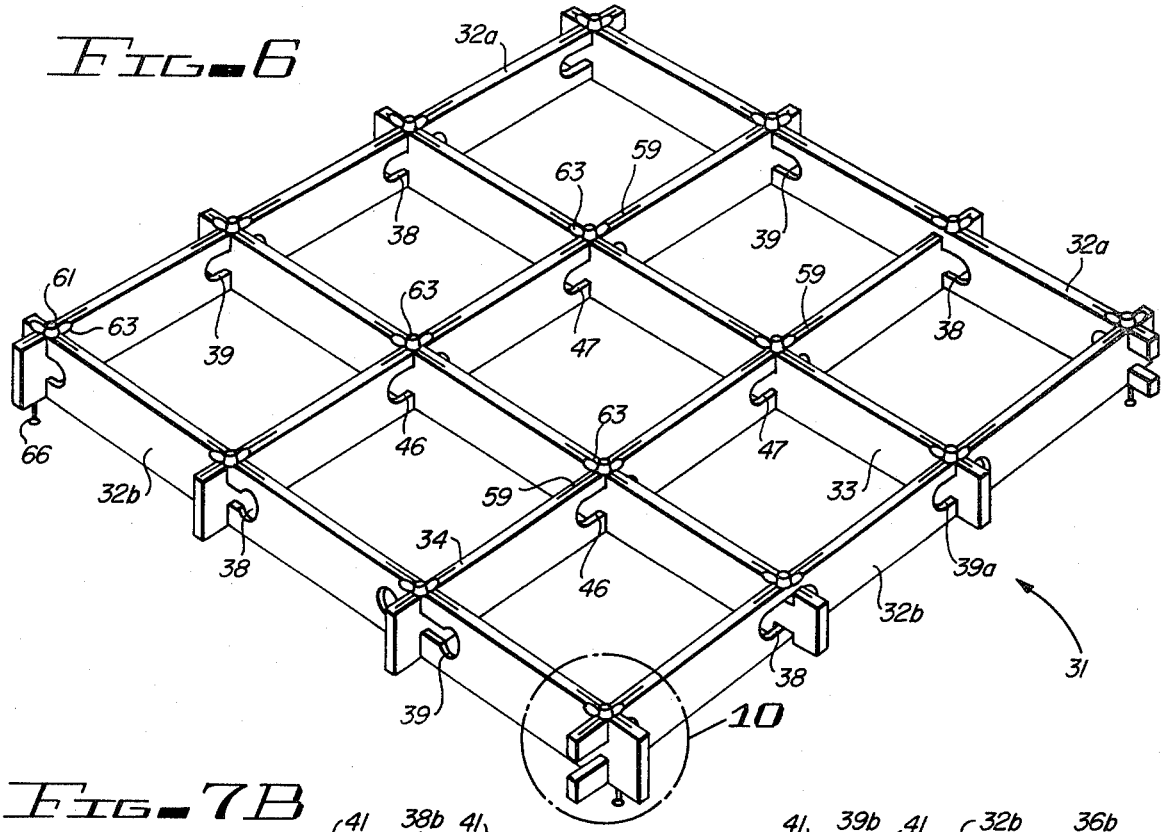
FIG. 7B
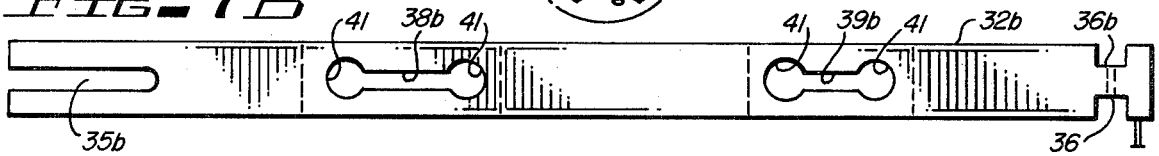
FIG. 8
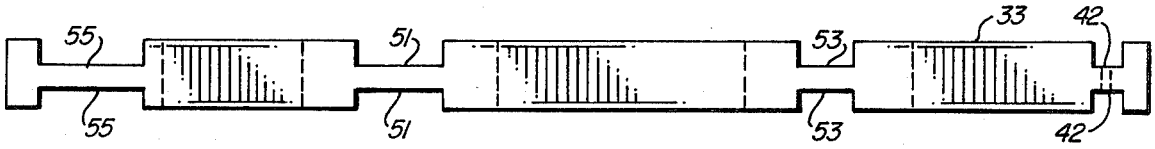
FIG. 9
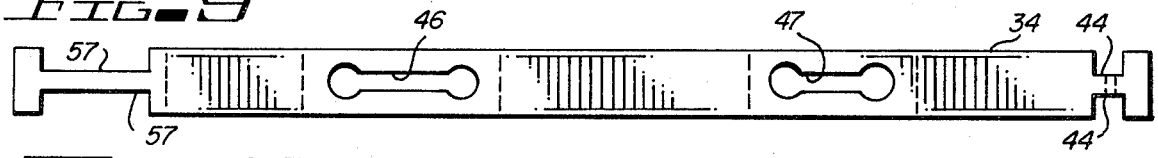
FIG. 10
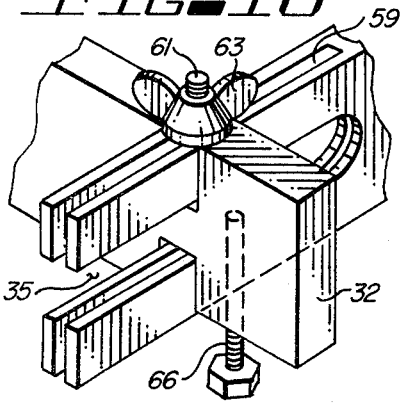
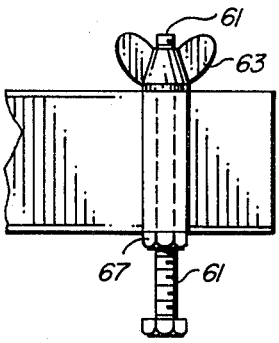
FIG. 11
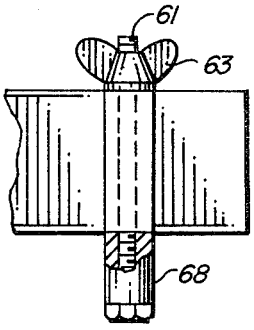
FIG. 12

FIG. 13A
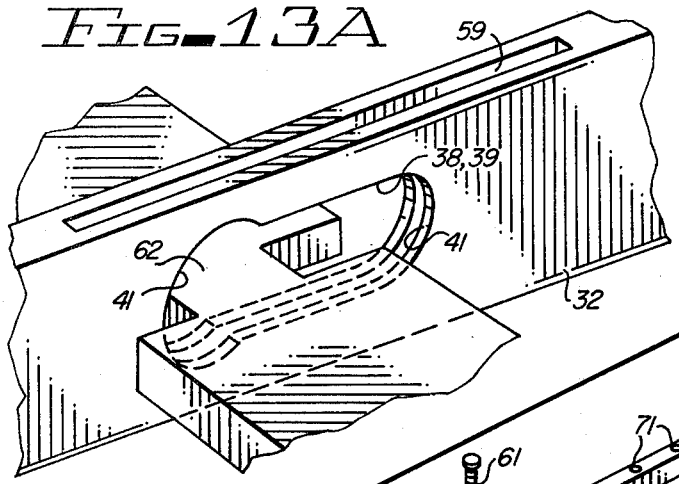
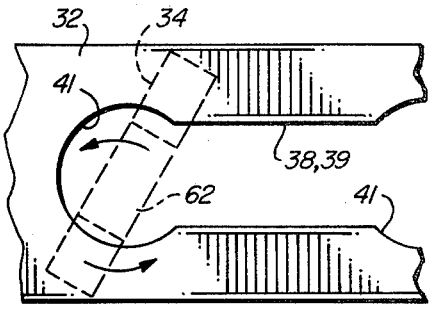
FIG. 13B
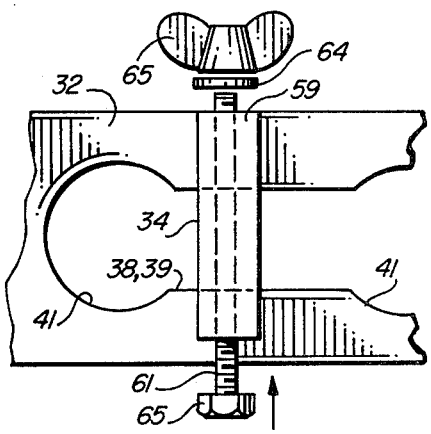
FIG. 13C
FIG. 14
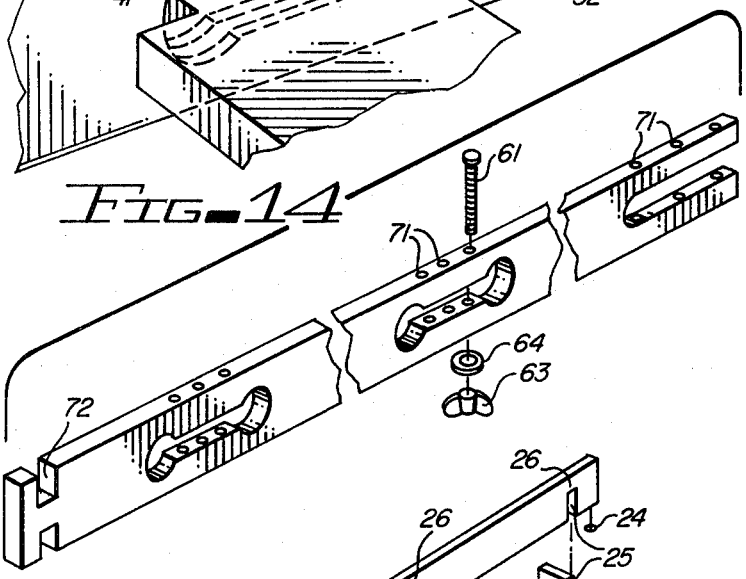
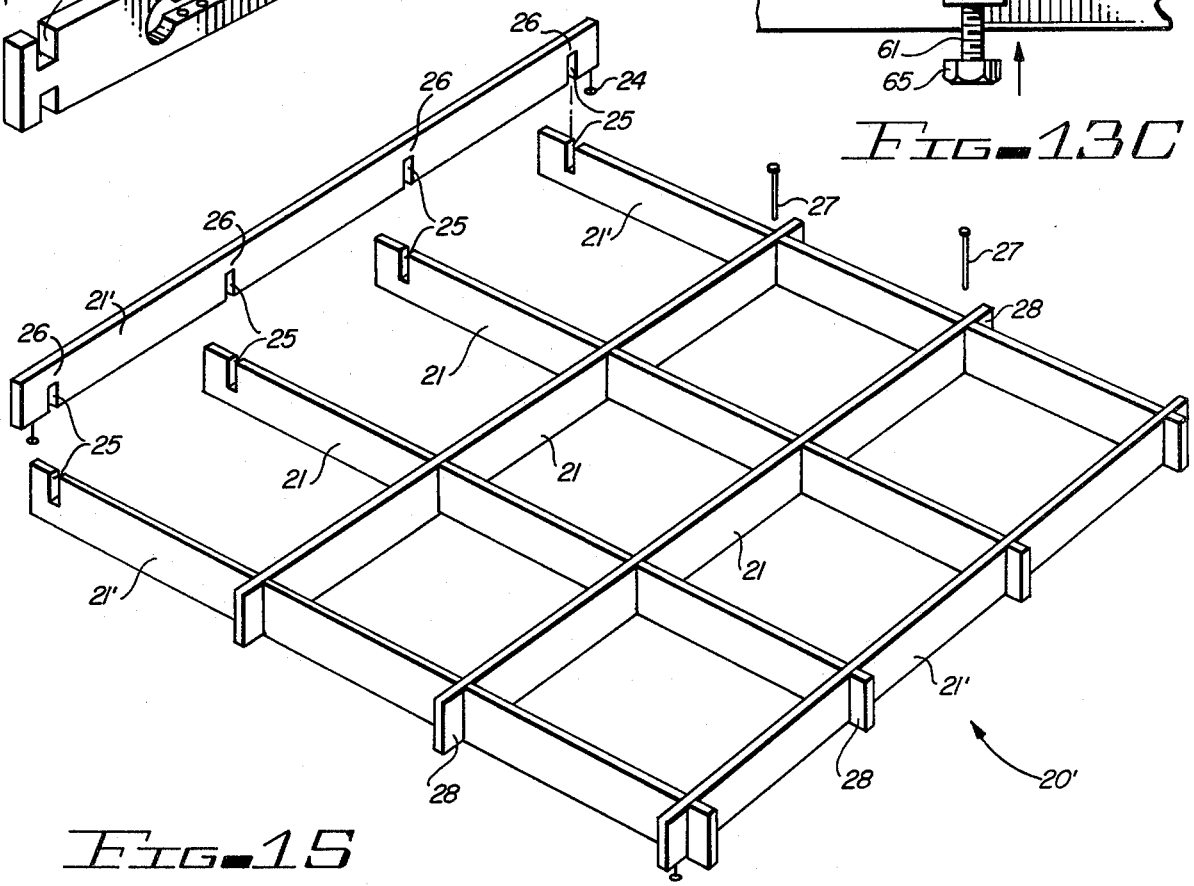
FIG. 15

RACK FOR LAYING ITALIAN AND QUARRY TILE

BACKGROUND OF THE INVENTION

Italian tiles have become increasingly popular in the United States in recent years for use in covering interior floors as well as outdoor patio areas. These tiles tend to be uniform in shape and dimension, much like the quarry tiles which are used commercially. The non-uniformity of a Mexican tile is a desirable feature aesthetically, as it gives the finished floor or patio surface a rough, textured hand-made appearance that harmonizes with rough-hewn wood and other features of certain types of architecture. It is common practice to install an irregularly shaped tile by eye with only the use of a tape measure to maintain a straight line configuration.

Unfortunately, however, the uniformity of the Italian tiles introduces problems associated with the placing or laying of the tiles. It is critical that tile placement be as uniform as the tile will permit. It is not easy to keep the tiles linearly aligned and uniformly spaced, and unless a reasonable degree of success is achieved along these lines, the installation will not have a professional appearance.

As an aid in assuring the proper alignment and spacing while laying such tiles, many professional tile layers utilize special frames or racks that serve as guides for the positioning or placement of the tiles. The rack comprises a framework or grid formed by perpendicularly intersecting rows and columns of partitioning walls. In the use of such a rack the person laying the tiles positions the rack on the floor surface after the surface has been covered with an adhesive. The tiles are then placed in the individual compartments of the rack. Finally, the rack is removed and the spaces between the tiles are filled with grout. If the tiles are centered within the individual compartments as they are placed, the desired alignment and spacing will be achieved without great difficulty.

Conventional racks of this type are not ideally suited to the intended purpose because they rest directly on the adhesive and require constant cleaning. In addition, they are typically made of metal strips that are welded together. This construction is heavy, bulky, difficult to handle and relatively expensive to manufacture. A further limitation of such presently available racks is that they are not adjustable to permit accommodation of different sizes of tiles.

Clearly, there is a need for an improved rack of this general type in which such undesirable features are eliminated.

SUMMARY OF THE INVENTION

In accordance with the invention claimed, an improved rack for laying tiles is provided in a form that substantially eliminates the undesirable features of presently available tile racks.

It is, therefore, one object of the present invention to provide an improved rack for laying Italian and other types of floor tiles.

Another object of this invention is to provide in such a rack a means for preventing the major surfaces of the rack from coming into contact with the tile adhesive that has previously been spread over the floor surface, the intent of this feature being to obviate the need for frequent and time consuming cleaning operations for removal of adhesive from the rack.

A further object of this invention is to provide such a tile rack in a form that is simple and inexpensive to manufacture so that it will be affordable by professionals and amateurs alike for use in laying tiles.

A still further object of this invention is to provide such a tile rack in a form that is light in weight so that it may be handled easily in use.

A still further object of this invention is to provide such a tile rack in a form that may be commercially distributed or stored in unassembled form and then very easily assembled prior to use, the intent of this feature being to reduce cost to the user and to reduce space requirements for shipping and storage.

Yet another object of this invention is to provide such a tile rack in a form that permits adjustment of the dimensions of the individual compartments of the rack so that the same rack may be employed for tiles of different dimensions.

Additional objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which:

FIG. 3 is an edge view of the tile rack of FIGS. 1 and 2;

FIG. 4 is a perspective view of a corner of the tile rack of FIGS. 1–3;

FIG. 5 is a second perspective view of the same corner shown in FIG. 4, but viewed from an angle that shows detail of the underside of the assembly;

FIG. 6 is a perspective view of a tile rack constituting a second embodiment of the invention in which a dimensional adjustment capability is provided;

Figure 1:
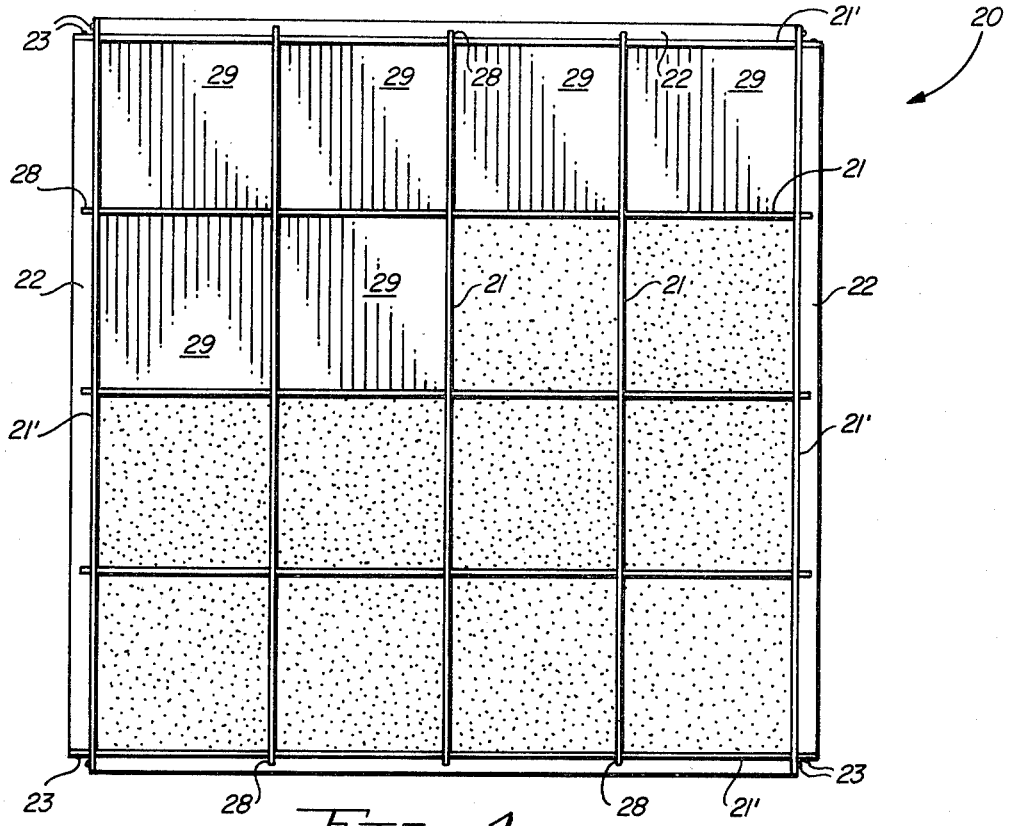
FIG. 1 is a top plan view of a first embodiment of an improved tile rack of the invention, the rack being shown in its intended use with a number of tiles having been placed in compartments of the rack.
Figure 2:
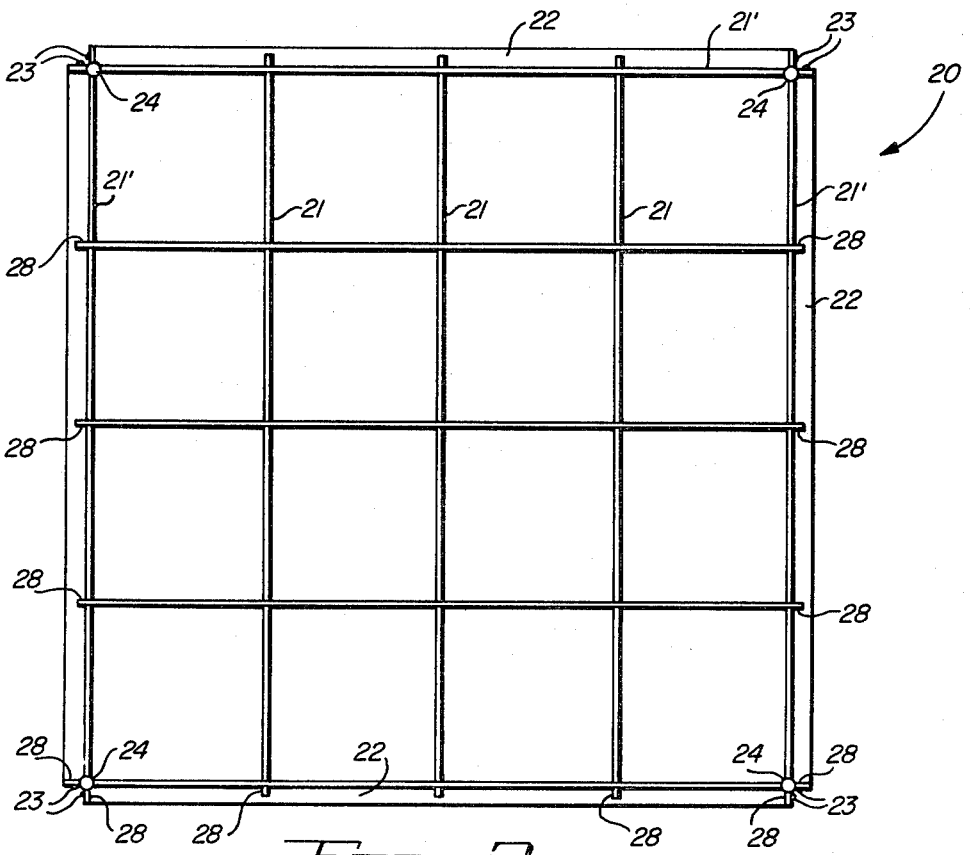
FIG. 2 is a second plan view of the tile rack of FIG. 1 as seen from the under side of the rack.

FIGS. *7a* and *7b* are plan views of first and second types of partitioning strips employed in the tile rack of FIG. 6;

FIG. 8 is a plan view of a third type of partitioning strip employed in the tile rack of FIG. 6;

FIG. 9 is a plan view of a fourth type of partitioning strip employed in the tile rack of FIG. 6;

FIG. 10 is an enlarged perspective view of the corner identified in FIG. 6 by circle 10.

FIG. 11 is an enlarged view of a variation of the means employed for elevating the tile rack of FIGS. 1–10;

FIG. 12 is an enlarged view of a second variation of the means shown in FIG. 11;

FIGS. 13A, 13B and 13C illustrate successive steps employed in the installation of one partitioning strip into another partitioning strip during the assembly of the tile rack of FIG. 6;

FIG. 14 is a perspective view of a variation of the partitioning strip of FIG. 7 in which an alternate means is provided for securing the relative positions of intersecting partitioning strips; and FIG. 15 is a perspective view of a partially assembled tile rack of the type shown in FIGS. 1–5.

DESCRIPTION OF THE PREFERRED EMBODIMENT

Referring more particularly to the drawings by characters of reference, FIGS. 1–5 disclose an improved tile rack 20 comprising a number of identical partitioning strips 21, four identical edge strips 22, eight screws 23 for holding the assembled rack together, and four elevating screws 24 for supporting rack 20 above the surface of the tile adhesive. While rack 20' shown in FIG. 15 is of the same general type as rack 20 of FIGS. 1–5, it comprises a nine compartment version, whereas rack 20 is a sixteen compartment configuration. For purposes of illustration, rack 20' is incomplete as shown. Additional parts including edge strips 22 must be added to complete the structure.

As shown more clearly in FIG. 15, each of the partitioning strips of FIGS. 1–5 and 15 comprises a rectangular strip of wood, metal, plastic or other suitable material which is provided with transverse slots 25 at regular intervals along its length which cooperate and coincide with similar slots in the perpendicular intersecting partitioning strips. Each of slots 25 extend half way across the width of strip 21 from a common edge thereof with laterally opposite slots 25 in bridging strips extending from an opposed side of the strip.

Racks 20 and 20' employ a known divider construction employed for many years in egg crates and the like, except that egg crate dividers are made of cardboard while racks 20 and 20' are made of a more substantial material. The width of slots 25 match the thickness of strip 21 so that when the strips are assembled together each slot 25 snugly engages a bridging section 26 of the perpendicularly intersecting strip 21. Because each slot 25 is cut perpendicular to the longitudinal axis of strip 21, a snug fit results, constraining the intersecting strips in a mutually perpendicular orientation. To secure the assembled strips 21 following their assembly as shown in FIG. 15, glue may be employed at the intersecting slots 25, or small brads 27 may be driven into the slotted joints.

As a means for facilitating the handling of rack 20, four edge strips 22 are installed as shown in FIGS. 1–5. These strips, together with the four outer strips 21', form a right angular configuration around the periphery of the rack. At the corners of rack 20, the edge strips 22 abut the extending ends 28 of the intersecting peripheral strip 21', as shown most clearly in FIGS. 4 and 5.

This arrangement permits strips 22 to be secured by means of screws 23 wherein each screw passes through the extending end 28 of a peripheral strip 21' into the end of the abutting edge strip 22. Both ends of each edge strip 22 are secured in this manner. The engagement of the abutting ends 28 with the accommodating slots of strips 22 adds to the stiffness of rack 20.

The use of edge strips 22 permits an alternate means for securing the partitioning strips. Glue or brads may be employed for this purpose with the glue applied to the extending ends 28 prior to the attachment of strips 22. Alternatively, brads may be driven through strips 22 into ends 28.

As shown in FIGS. 3–5, edge strips 22 are approximately half as wide as partitioning strips 21. This dimensional relationship facilitates the gripping of the edge of the rack 20 with the fingers of the user during the lifting of the rack from the floor surface or while placing it on the surface.

An elevating screw 24 is installed on the underside of each corner of rack 20. Screw 24 enters the edge of a peripheral partitioning strip 21' at or near its intersection with another peripheral strip 21'. The elevating screw 24 is only partially installed so that its head and a predetermined portion of its body extend downwardly from the underside of rack 20. The four screws 24 installed in this manner serve as supports for rack 20, their heads resting on the adhesive coated floor surface. The extending screws 24 support the under surface of rack 20 at a controlled distance above the surface of the adhesive so that the under surface of the rack does not become contaminated with adhesive during normal use.

When using tile rack 20, an adhesive is first spread over the selected area to be tiled. Rack 20 is then placed over the area covered by the adhesive taking care to assure that the tile positions as defined by the compartments of the rack 20 are properly positioned and aligned with the boundaries of the area to be covered and with any tiles that have already been laid. As rack 20 is set down on the adhesive, the elevating screws 24 support the four corners of the rack. The adhesive that has been spread on the selected area comes into contact with screws 24 with the bottom edges of the partition strips elevated slightly above the top surface of the adhesive. Because edge strips 22 are not as wide as partitioning strips 21 and are flush with strip 21 along their top edges, clearance is provided under their lower or bottom edges so that no interference will be encountered with tiles already placed in an adjacent area. Having positioned rack 20, the user then proceeds to position tiles 29 in the various compartments of rack 20, as shown in FIG. 1. As the tiles are centered in the individual compartments, they are automatically aligned and spaced with little difficulty. Having placed tiles in all the compartments, the tile layer then removes the rack and places it in its next position to continue the tile laying process. After the tiles have been laid in a given area, grout is placed between the tiles in the usual manner.

FIGS. 6–13C disclose another embodiment of the invention illustrating an adjustable tile rack 31 comprising four different partitioning strips **32*a*, 32*b*, 33 and 34**. These strips are specially formed to permit subsequent adjustment of their relative positions in the rack to effect a desired compartment size.

As shown in FIG. 6, rack 31 has nine compartments formed by a set of eight partitioning strips comprising two strips **32*a*, two strips 32*b*, two strips 33 and two strips 34. Strips 32*a*, 32*b*, 33 and 34 are notched or slotted in the point of intersection with another strip. As noted, strips 32*a* and 32*b*** are notched differently at their ends so as to accommodate movement of other intersecting strips, as will be hereinafter explained.

Strips **32*a* and 32*b* are positioning strips employed to form the periphery of a right angle parallelogram or rack 31. As shown in FIGS. 7*a* and 7*b*, strips 32*a* and 32*b* each have open longitudinal slots 35*a* and 35*b*, as shown at their right and left ends, respectively, and notches 36*a* and 36*b* in the upper and lower edges of their other ends, respectively. At intermediate locations between their ends, strips 32*a* and 32*b* are provided with two longitudinally extending slots 38*a*, 38*b* and 39*a* and 39*b*, respectively. Slots 38*a* and 38*b* are located one-third of the way and slots 39*a* and 39*b* two-thirds of the way from the left to the right ends thereof. Each of slots 38***a*, 38*b* and 39*a*, 39*b* has a circular enlargement 41 at its ends. The width of notch 36*b*, as measured in the direction of the length of strip 32*b*, is equal to the thickness of strip 32*b*, which is the same as the thickness of strips 32*a*, 33 and 34. The length of slots 38*a*, 38*b* exclusive of the circular enlargement 41, is substantially twice the length of slots 39*a* and 39*b* measured in the same manner, and the length of the open slot 35*b* is at least three times the length of slots 39*a* and 39*b*.

Positioning strips 32*a*, 32*b*, 33 and 34 have the same overall length, width and thickness dimensions. As shown in FIGS. 7*a*, 7*b*, 8 and 9, strips 33 and 34 are seen to be notched or grooved at each location corresponding to the locations of notches 36 and 37 and grooves 35*a* and *b*, 38*a* and *b* and 39*a* and *b*. Strip 33 has upper and lower notches 42 at its right end and strip 34 has upper and lower notches 44 at its right end. Notches 42 and 44 have the same dimensions as notch 36. Strip 34 has two longitudinal slots 46 and 47 at intermediate positions. Slot 46 is identical in shape and size to slots 38*a* and *b* and slot 47 is identical in shape and size to slots 39*a* and *b*. Slots 46 and 47 occupy the same relative positions along the length of strip 34 as those occupied by slots 38*a* and *b* and 39*a* and *b*, respectively, along the length of strip 32.

In the same corresponding intermediate positions of strip 33 are two sets of upper and lower notches. Thus, at the position corresponding to slots 38*a* and 38*b* are formed upper and lower notches 51, while at the position corresponding to slots 39*a* and *b* are formed upper and lower notches 53. The longitudinal lengths of notches 53 are the same as the longitudinal length of slots 39*a* and *b* and 47, neglecting the enlarged portions 41. The lengths of notches 51 are the same as the length of slots 38*a* and *b* and 46, again neglecting the enlarged portions 41. At the left end of strip 33 is another set of upper notches 55. Notches 55 are three times as long as notches 53. Upper and lower notches 57, which are identical to notches 55*a* and *b* and 56*a* and *b* are provided at the left end of strip 34.

The peripheral edges of each of the notches and slots of strips 32*a* and *b*, 33 and 34 are grooved or slotted edgewise, as shown in FIG. 6. This edge groove 59 provides clearance for a clamping screw 61 at each point of intersection of the partitioning strips 32*a* and *b*, 33 and 34.

The partitioning strips 32–34 are assembled to form rack 31 in the following manner.

The four positioning strips 32*a* and *b* are first assembled to form the periphery of the rack. This is accomplished by arranging the four strips 32*a* and 32*b* to form a square with the notched end of strip 32*a* meeting the slotted end of the other strip 32*a* and the notched end of strip 32*b* meeting the slotted end of the other strip 32*b*. The slotted end of strip 32*a* is then positioned to meet the notched end of 32*b*, and the notched end of strip 32*a* meets the slotted end of strip 32*b*. After this is accomplished, the notches are inserted into the slots to form the square rack as shown in FIG. 6. The four strips are then secured together by inserting a screw 61 through the intersecting edge grooves 59 at each corner of the rack and secured by a wing nut 63.

The two positioning strips 34 are then added to the assembly by passing them through slots 38*a* and *b* and 39*a* and *b* of the two parallel and opposite strips 32*a* and *b* already assembled. This is accomplished by first rotating the strip to an orthogonal orientation relative to strip 32, as shown in FIG. 13A, so that strip 34 may be passed through the aligned slots 38*a* and *b* or 39*a* and *b* of a pair of opposite strips 32*a* and *b* of the partially assembled rack 31. While the notched ends of strip 34 are aligned with slots 38*a* and *b* or 39*a* and *b*, strip 34 is moved to the circularly enlarged end of slot 38*a* and *b* or 39*a* and *b*, as shown in FIG. 13B, and is then rotated ninety degrees to an upright position. Strip 34 is then moved laterally into the portion of slots 38*a* and *b* or 39*a* and *b* that is not enlarged, as shown in FIG. 13C, where it is locked into the desired position by means of a clamping screw 61 that is passed through the intersecting edge grooves or slots 59 of strips 32 and 34, as shown in FIG. 10. A wing nut 63 applied to each of screws 61 completes this part of the assembly. As shown in FIG. 13C, a washer 64 may be employed under the wing nut 63, if so desired. It may also prove convenient to employ a screw 61 with a square or hex head 65 (also as shown in FIG. 13C) that can be captured in edge slot 59.

Having assembled strips 32*a* and *b* and 34, as just described, two strips 33 are then passed through slots 46 and 47 of the two strips 34 just assembled and through the remaining slots 38*a* and *b* and 39*a* and *b* where they are positioned and secured in the manner described earlier for the installation of strips 34.

The assembly of rack 31 is completed by adding elevating screws or bolts at each of the four corners of the rack for support above the tile adhesive. The elevating bolt may take any one of a number of forms.

In FIG. 10, an elevating bolt 66 is simply threaded into the underside of one of strips 32 as in the case of the elevating screw 24 of the first embodiment of the invention shown in FIGS. 1–5.

In a second form, as shown in FIG. 11, an extra long clamping bolt 61 and a wing nut 63 are employed in conjunction with a hex nut 67. The hex nut 67 is first threaded over bolt 61 to a predetermined distance from the head of bolt 61. The open end of bolt 61 is then passed through a hole in the edge of strip 32 until nut 67 bears against the underside of strip 32. Bolt 61 is then secured in position by means of wing nut 63. The predetermined distance of nut 67 from the head of bolt 61 sets the clearance distance of rack 31 above the surface of the adhesive.

Yet another form of a rack elevating means is shown in FIG. 12 where a hollow sleeve 68 of an appropriate length is substituted for nut 67 of FIG. 11. In this case, the sleeve is first passed over the body of bolt 61. The end of the bolt is then passed through the hole in strip 32 and wing nut 63 secures the assembly.

It will be apparent that the elongated slots and grooves in strips 32*a* and *b*, 33 and 34 permit a continuous adjustment of the dimensions of rack 31 over a range determined by the lengths of slots 35*a* and *b*, 38*a* and *b*, 39*a* and *b*, 46 and 47 and the lengths of notches 36*a*, 51, 53, 55 and 57. It will be recognized that the positions of strips 32*a* and *b*, 33 or 34 secured within notches 36*a* and *b*, 42 and 44 may be fixed for uniform compartment dimensions over the entire rack 31. Dimensional adjustments are accumulative at each successive position moving away from the fixed position. This accounts for the difference in the dimensions of the slots and notches in strips 32–34.

The use of rack 31 in the tile laying process is the same as described for rack 20 except that the rack dimensions may in this case be optimized relative to a given lot of tiles. Rack 31 may also be disassembled for storage purposes.

In place of the edgewise slot 59 that is provided in strips 32–34 to receive clamping screws or bolts 61, clearance holes 71 may be employed, as shown in FIG. 14. While the slots 59 permitted a continuous adjustment, the holes permit incremental adjustments. It will be noted that only one hole 71 is employed at the left end of the strip in FIG. 14, this end remaining fixed while adjustments are made at the other positions. To accommodate the progressively larger adjustments at the other positions, as observed in moving from left to right, holes 71 are seen to be spaced apart a progressively larger distance.

The same clamping screw or bolt 61, washer 64 and wing nut 63 may be employed in holes 71.

An improved rack for laying Italian and other types of tile has thus been provided in accordance with the stated objects of the invention. Although but a few embodiments of the invention have been illustrated and described, it will be apparent to those skilled in the art that various changes and modifications may be made therein without departing from the spirit of the invention or from the scope of the appended claims.

What is claimed is:

1. A rack for laying tile comprising:

four edging strips arranged to form in end to end arrangement a right angle parallelogram, one end of each edging strip being notched longitudinal of its length a given distance to receive cooperating notches formed in one of the other ends of said edging strips when they are arranged in end to end arrangement, each of said edging strips being provided with a pair of like, spacedly arranged slots extending longitudinally thereof, the ends of which are enlarged, at least one partition strip extending laterally between one pair of parallelly arranged edging strips, at least another partition strip extending laterally between another pair of parallelly arranged edging strips, one of said partition strips being provided between its ends with a longitudinally extending slot long and wide enough to receive longitudinally therethrough the other of said partition strips, the other of said partition strips being notched inwardly of each of its edges at a point along its length corresponding to the position of said slot in said one of said partition strips, said other of said partition strips when inserted in said slot of said one of said partition strips with its notches aligned with said slot of said one of said partition strips and rotated ninety degrees aligning edge to edge in a common plane with said edging strips and said one of said partition strips, and a first means for then locking said partition strips in their relative positions.

2. The rack set forth in claim 1 wherein:

the width of said other of said partition strips between its notches is slightly less than the width of said slots in said one of said partition strips.

3. The rack set forth in claim 1 wherein:

said first means for locking said partition strips in their relative positions comprises a bolt and wing nut assembly extending through the intersecting partition strips.

4. The rack set forth in claim 3 wherein:

said intersecting partition strips are slotted longitudinally thereof adjacent the point of intersection for limited relative movement of said intersecting partition strips, one relative to the other.

5. The rack set forth in claim 1 wherein:

said one end of each edging strip is slotted longitudinally thereof a predetermined distance, and a second locking means is provided for extending through the slots in said one end and through said notched end of the said other end of an adjoining edging strip for locking said adjoining edging strips in given relative positions.

6. The rack set forth in claim 3 wherein:

each of said one of said partition strips is provided with at least two holes extending laterally through the width of and the periphery of the slots in said partition strips for receiving said first means for selectively locking said partition strips in given relative positions.

7. The rack set forth in claim 6 wherein:

the spacing between the holes passing through common slots in each of said one of said partition strips is different than the spacing between the holes passing through common locations in each of said one of said partition strips.

* * * * *